US008148969B2

(12) United States Patent
Zametzky

(10) Patent No.: US 8,148,969 B2
(45) Date of Patent: Apr. 3, 2012

(54) CIRCUIT ARRANGEMENT FOR THE REGULATION OF A CURRENT THROUGH A LOAD

(75) Inventor: Klaus Zametzky, Schwabach (DE)

(73) Assignee: SITRONIC Ges. fuer Elektrotechnische Ausruestung mbH & Co. KG, Gaertringen (DE)

( * ) Notice: Subject to any disclaimer, the term of this patent is extended or adjusted under 35 U.S.C. 154(b) by 839 days.

(21) Appl. No.: 12/220,106

(22) Filed: Jul. 22, 2008

(65) Prior Publication Data

US 2009/0027017 A1 Jan. 29, 2009

(30) Foreign Application Priority Data

Jul. 27, 2007 (DE) ..... 10 2007 035 339

(51) Int. Cl.
*G05F 3/04* (2006.01)
*G05F 1/00* (2006.01)

(52) U.S. Cl. ..... 323/312; 323/274

(58) Field of Classification Search ..... 323/273–281, 323/265–266, 311–312
See application file for complete search history.

(56) References Cited

U.S. PATENT DOCUMENTS

| | | | | |
|---|---|---|---|---|
| 3,076,135 | A | 1/1963 | Farnsworth et al. | |
| 3,512,047 | A | 5/1970 | Garde | |
| 3,753,078 | A * | 8/1973 | Hedel | 323/277 |
| 3,959,713 | A | 5/1976 | Davis et al. | |
| 4,095,164 | A * | 6/1978 | Ahmed | 323/226 |
| 4,941,080 | A * | 7/1990 | Sieborger | 363/127 |
| 5,619,163 | A * | 4/1997 | Koo | 327/539 |
| 5,718,373 | A * | 2/1998 | Kim et al. | 236/35 |
| 2003/0076638 | A1 * | 4/2003 | Simonelli et al. | 361/56 |
| 2003/0147193 | A1 | 8/2003 | Hamon et al. | |
| 2005/0035749 | A1 | 2/2005 | Bo et al. | |
| 2008/0129261 | A1 * | 6/2008 | Oelmaier | 323/273 |

FOREIGN PATENT DOCUMENTS

DE 102005010013 A1 9/2006

* cited by examiner

*Primary Examiner* — Adolf Berhane
*Assistant Examiner* — Jeffrey Gblende
(74) *Attorney, Agent, or Firm* — Walter A. Hackler

(57) ABSTRACT

A circuit arrangement (1) for the regulation of a current ($I_L$) through a load ($R_L$) comprises: a resistance ($R_S$), through which a load current ($I_L$) flows and across which a voltage ($V_S$) drops, which serves as a control variable (X) for the regulation of the load current ($I_L$), a tapping point (P) for a reference voltage ($V_{ref}$), which serves as a command variable (W) for the regulation of the load current ($I_L$), and a differential amplifier for the amplification of the control deviation (W–X) between command variable (W) and control variable (X). In the circuit arrangement (1) are provided for the regulation of the load current ($I_L$) as a function of the load voltage ($V_L$) a transistor (Q4) and also a collector resistance (R2) and an emitter resistance (R6), wherein the series connection of the base-emitter section of the transistor (Q4) and the emitter resistance (R6) is arranged parallel to the load ($R_L$), and wherein the tapping point (P) for the reference voltage is arranged between the collector resistance (R2) and the transistor (Q4).

7 Claims, 2 Drawing Sheets

CIRCUIT ARRANGEMENT FOR THE REGULATION OF A CURRENT THROUGH A LOAD

The invention concerns a circuit arrangement for the regulation of a current through a load with: a resistance, through which a load current flows and across which a voltage drops, which serves as a control variable for the regulation of the load current, a tapping point for a reference voltage, which serves as a command variable for the regulation of the load current, and a differential amplifier for the amplification of the control deviation between command variable and control variable.

By means of the circuit arrangement a control circuit for a fan motor serving as a load in a motor vehicle fan can, for example, be provided, which undertakes the function of short circuit and excess current protection for the fan motor. The excess current protection is hereby implemented in terms of a current limiting function, i.e. in the fan regulator is located a control circuit, which controls the control voltage of a power transistor serving as an actuating element in a limiting manner such that the motor current remains below a prescribed threshold value.

A circuit arrangement 10 of this type is shown in FIG. 2 as a control circuit for a fan motor of a motor vehicle fan. The circuit arrangement 10 is operated with a supply voltage $V_B$ of 14 V, which is supplied from a vehicle battery and/or generator (not shown). A load current $I_L$ through the fan motor, represented in FIG. 2 as a load resistance $R_L$, is controlled by the adjustment of the control voltage of a power transistor M1 (MOS-FET) serving as an actuating element such that it does not exceed a maximum value. As a control variable X hereby serves a voltage drop $V_S$ across a shunt resistance $R_S$, arranged in the load current circuit, through which the load current $I_L$ flows, which has a value in the mΩ range. As a command variable W for the regulation of the load current $I_L$ a reference voltage $V_{ref}$ is provided at a tapping point P, which voltage serves as a reference for the load current $I_L$ in the event of a short circuit, and which can lie in the mV range. The circuit arrangement 10 has furthermore a differential amplifier OV for the amplification of a control deviation W−X between the command variable W and the control variable X, in order to regulate in a limiting manner the control voltage of the power transistor M1.

The circuit arrangement shown in FIG. 2 limits the load current $I_L$ to a constant value, which is determined by the reference voltage $V_{ref}$. In the normal operation of a motor vehicle fan, however, in addition to effective short circuit protection a high motor current flow should also be guaranteed, which can be achieved in that the maximum load current $I_L$ is a function of the voltage $V_L$, which drops across the load, that is to say across the fan motor, i.e. the following relationship should apply: $I_L=f(V_L)$, where the maximum motor current draw increases with increasing voltage $V_L$.

Furthermore the circuit arrangement 10 shown in FIG. 2 also does not provide optimal results if the power consumption through the load resistance $R_L$ is not constant, but is e.g. a function of the ambient temperature. This is e.g. the case for a fan motor of a motor vehicle fan, in particular because hot air, due to the more rapid movement of the air molecules, provides a higher flow resistance for the fan motor than cold air, since in a given period of time and spatial volume statistically there are more frequent collision events between molecules in hot air than in cold air. In an analogous manner to the electron gas in a metallic conductor, in which the mobility of the electrons reduces with temperature, and the electrical resistance increases, the flow resistance of the air flow in an HVAC (Heating, Ventilation and Air Conditioning) system also rises with the gas temperature. If the air flows more slowly the fan motor draws less current than at a high air flow velocity. Many air conditioning systems therefore have the property of drawing more current at a given motor voltage under cold conditions than under hot conditions.

The motor current draw therefore reduces with the temperature. For the control of the fan motor with a linear fan regulator this behaviour proves to be favourable, because with reducing motor current consumption the power dissipation in the power transistor of the fan regulator also reduces. Since the maximum permissible power dissipation of the fan regulator reduces with increasing ambient temperature, it would therefore be beneficial if the maximum load current $I_L$ were to reduce with increasing temperature, i.e. were to be a function of the temperature T ($I_L=f(T)$).

To achieve a regulation of the maximum load current as a function of temperature it is known in the art to use a temperature sensor. Such a temperature sensor with an associated circuit arrangement is, however, associated with high costs, in particular for motor vehicle applications, the function of which must be guaranteed over a large temperature range from −30° C. to 150° C.

SUMMARY OF THE INVENTION

The object of the invention is to provide a cost-effective circuit arrangement, consisting of a small number of components, for the regulation of the current by a load, in particular a fan motor, in which the load current can be regulated as a function of the voltage drop across the load and preferably as a function of temperature.

This object is achieved by the circuit arrangement of the type cited in the introduction, in which for the regulation of the load current as a function of the load voltage a transistor and also a collector resistance and an emitter resistance are provided, wherein the series connection of the base-emitter section of the transistor and the emitter resistance is arranged parallel to the load, and wherein the tapping point of the reference voltage is arranged between the collector resistance and the transistor. In this manner it can be achieved that the load current increases in proportion with the load voltage, since the collector current of the transistor, essential for the adjustment of the reference voltage at the tapping point, includes a component proportional to the load voltage. In the context of this application collector resistance and emitter resistance are understood to be discrete components that are arranged in the related collector and emitter circuits, respectively.

In a preferred embodiment the differential amplifier has a first and a second base-coupled transistor. In contrast to conventional differential amplifiers, whose input stage as a rule is formed from emitter-coupled transistors, whereby a high input impedance is achieved, in the present circuit a high input resistance of the differential amplifier is not necessary, since the shunt resistance used in the circuit arrangement is embodied as a low resistance. Therefore base-coupled transistors can be used in the differential amplifier in the circuit arrangement according to the invention.

In an advantageous further development of this embodiment the circuit arrangement has a device for the adjustment of a constant ratio of the collector quiescent currents through the base-coupled transistors, which preferably is formed by two resistances. The inventor has recognised that the regulation of the load current as a function of temperature can be implemented via a defined temperature behaviour of the circuit arrangement, that is to say, via individual components of this circuit arrangement. In this manner the use of a temperature sensor can be avoided.

As a temperature sensor signal is hereby used the offset voltage of a (base-coupled) differential amplifier, the transistors of which are specifically operated at differently weighted collector quiescent currents. In this manner in a circuit arrangement, in which the load current is a function of the difference between the base-emitter voltages of the two base-coupled transistors, a constant temperature coefficient, i.e. a linear relationship between load current and temperature, can be achieved. The temperature coefficient can hereby be defined as a function of the ratio of the currents to one another, both in magnitude and also in sign. Therefore the circuit can be dimensioned such that it allows higher currents at low temperatures and lower currents with increasing temperature, and thus adjusts itself to the temperature behaviour of the load, wherein the temperature behaviour of the circuit is achieved exclusively by component dimensioning. For the temperature control functions no further components are therefore required.

The load current can be regulated as a function of the temperature of an ambient medium, in particular of the air-flow of an air-conditioning system or the cooling fluid of a cooling water circuit, with which the two base-coupled transistors are thermally coupled. Alternatively or additionally the load current can also be regulated as a function of the temperature of a power transistor serving as an actuating element, or of the temperature of the load, if the two base-coupled transistors are thermally coupled with the power transistor or the load, respectively. In this manner any thermal overheating of these components can be prevented.

In the regulation of a motor vehicle fan high motor currents are possible with such a circuit, e.g. in winter when the electronic systems are cold. With increasing ambient temperature the intervention threshold of the current limiting regulator reduces, it protects the fan regulator electronics, but also connector contacts, lines and finally also the fan motor from thermal stress. Nevertheless the electronics provide a high performance if the temperatures are not critical. The dimensioning of some of the parts of the air-conditioning systems can become more refined and more cost-effective with the use of such a circuit arrangement.

Preferably the device is formed in terms of two resistances, wherein the circuit arrangement is dimensioned such that the ratio of the collector currents is essentially given by the ratio of the resistances. Here the resistances are arranged in the respective collector circuits of the transistors. Alternatively e.g. two constant current sources can also be provided for the adjustment of a constant ratio of the collector currents. It is furthermore advantageous for the temperature regulation if the two base coupled transistors have the same collector-emitter voltages.

In a particularly preferred embodiment the base-coupled transistors of the differential amplifier are formed by a dual transistor. In this case the two transistors are thermally coupled and have paired properties, which is beneficial for the defined adjustment of the temperature dependence of the circuit.

An advantageous embodiment has at least one further transistor, preferably a power transistor, as an actuating element for the manipulation of the load current. Power transistors are required e.g. for the control of large currents, such as occur in fan motors of motor vehicles. The power transistor is preferably designed as a MOSFET, whereby the adjustment of the load current is made possible in a voltage controlled manner, i.e. practically without a control current.

In a preferred embodiment the control circuit has a third transistor for the regulation of the control voltage of the further transistor in a limiting manner. The control voltage of the power transistor is limited to a maximum value via the third transistor. With a suitable interconnection of the transistor, e.g. with a resistance, the gate voltage of the power transistor can be reduced, if the collector current of the third transistor increases.

In a further advantageous further development the differential amplifier and the third transistor are placed in the circuit such that the third transistor adjusts the control voltage of the further transistor as a function of the control deviation. This enables the implementation of a control circuit in a particularly simple manner.

It is particularly preferred to construct the circuit arrangement from discrete components. Such a circuit is robust and can therefore also be operated at high temperatures up to 150° C. Furthermore it is possible to implement the circuit arrangement with relatively few components, and in particular no temperature sensor is required.

The invention is also implemented in a motor vehicle fan with a circuit arrangement according to one of the preceding claims, in which the load is formed by a fan motor. With a current control system, which is controlled as a function of the temperature and the load voltage, excess current and short-circuit protection can be implemented in a fan regulator that monitors the motor current over the whole current-voltage characteristic of the motor. Here the circuit allows only motor currents that realistically match up to the motor voltage that is present.

BRIEF DESCRIPTION OF THE DRAWINGS

Examples of embodiments of the circuit arrangement according to the invention are represented in the schematic drawings and are elucidated in the following description. In the figures.

DETAILED DESCRIPTION

Figure 1:
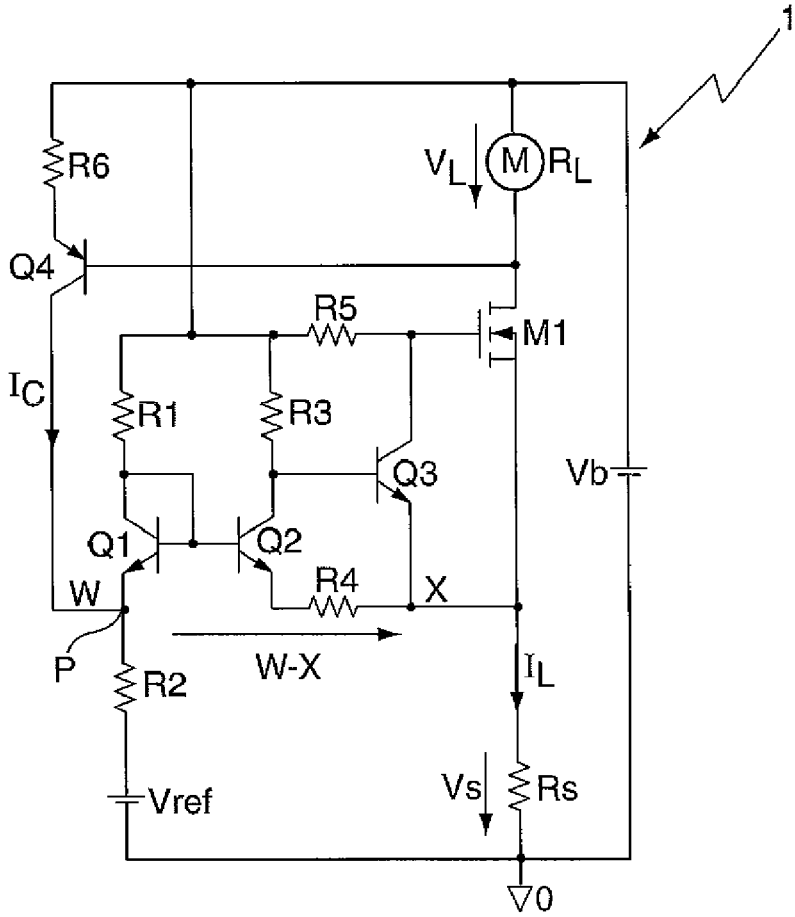
FIG. 1 shows a circuit diagram of an embodiment of the circuit arrangement according to the invention for the regulation of a load current through a fan motor.
Figure 2:
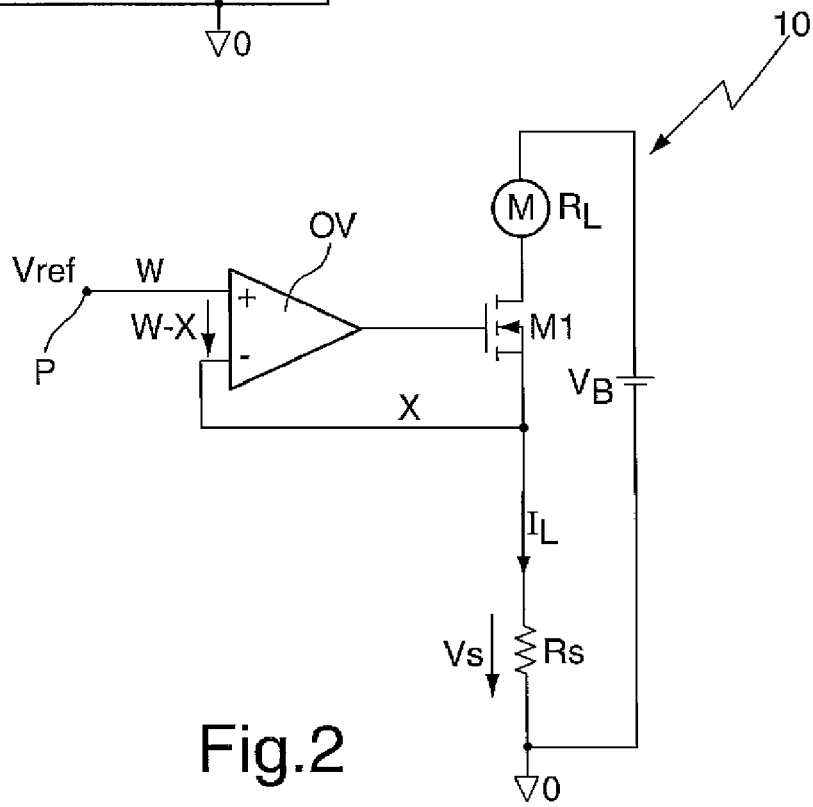
FIG. 2 shows a circuit diagram for the regulation of a load current according to the prior art.

FIG. 1 shows a circuit arrangement 1 for the regulation of the load current $I_L$ of a load $R_L$ as a function of the load voltage $V_L$ and the ambient temperature T, i.e. $I_L=f(V_L, T)$. The circuit arrangement 1 has the components described above in connection with FIG. 2, which at this point will not be described again. The differential amplifier OV shown in FIG. 2 is deployed in the form of discrete components in FIG. 1, and has two base-coupled, paired-parameter bipolar transistors Q1 and Q2, which are thermally coupled. In the first of the two transistors Q1 the base-collector section is shunted out. In the collector circuit of the first transistor Q1 is located a first resistance R1 (in the kΩ range), and in the collector circuit of the second transistor Q2 is located a third resistance R3 (likewise in the kΩ range), with which the ratio of the collector currents (not shown) of the two transistors Q1, Q2 can be adjusted.

A third transistor Q3 is provided in the circuit arrangement for the regulation of the control voltage for the power transistor M1 in a limiting manner.

The third transistor Q3 controls the current flow through a fifth resistance R5 (likewise in the kΩ range), which is placed in the circuit between the power transistor M1 and the supply voltage Vb, so that the control voltage of the power transistor M1 can be adjusted via the voltage drop across the fifth resistance R5. The control deviation W−X, i.e. the difference between the voltage at the tapping point P (command variable W) and the voltage on the shunt resistance $R_S$ (in the mΩ range) (control variable X) drops across a series connection of the base-emitter sections of the two transistors Q1, Q2 and a fourth resistance R4 (in the Ω range). The base of the third transistor Q3 is hereby connected to the collector of the second transistor Q2, so that the same voltage drops across the base-emitter section of the third transistor Q3 as across the series connection of the collector-emitter section of the second transistor Q2 and fourth resistance R4. If the fourth resistance R4 is dimensioned to be sufficiently low such that U(R4)<<UBE(Q3) this ensures that the two transistors Q1 and Q2 are operated at approximately the same collector-emitter voltage. The control voltage of the power transistor M1 self-adjusts across the collector-emitter section of the third transistor Q3 as a function of the control deviation. If the control deviation W−X increases, the base-emitter voltage of the second transistor Q2 increases such that its collector current increases. As a result the base potential of the third transistor Q3 reduces, as does its collector current. As a result the voltage drop across a fifth resistance R5 reduces, so that the gate potential of the power transistor M1 increases, as does the load current $I_L$. This has the result that the control variable X on the shunt resistance $R_S$ increases, whereby the control deviation W−X reduces, so that the circuit arrangement 10 forms a closed control circuit.

For the regulation of the load current $I_L$ as a function of the load voltage $V_L$ a fourth transistor Q4 and also a collector resistance R2 and an emitter resistance R6 are provided in the circuit arrangement 1, wherein the series connection of the base-emitter section of the fourth transistor Q4 and the emitter resistance R6 is arranged in parallel to the load, and wherein the tapping point P for the reference voltage is arranged between the collector resistance R2 and the fourth transistor Q4. The voltage drop across the collector resistance R2 is hereby adjusted via the collector current $I_C$ of the fourth transistor Q4, such that the reference voltage provided at the tapping point P is composed of a constant component $V_{ref}$ and the variable voltage drop across the collector resistance R2, which is dependent on the load voltage $V_L$. Hereby the fact is utilised that the collector current $I_C$ is a function of the voltage drop across the emitter resistance R6, which apart from a constant additive term is proportional to the load voltage $V_L$.

In what follows the function of the circuit arrangement 1 during operation for the regulation of the load current $I_L$ is described with the aid of equations that relate the currents and voltages on the components shown in FIG. 1. The notations occurring in the equations below are essentially self-explanatory. Thus e.g. $I_C$(Q4) designates the collector current through the fourth transistor Q4, while U(R4) designates the voltage drop across the fourth resistance, etc.

The notations R1 to R5 used for the designation of the resistances as components are hereby identified with the related values of these resistances.

If the circuit arrangement 1 regulates the load current $I_L$, then at least the transistors Q1 to Q3 are operated at their linear working points. Neglecting the base currents one can derive the following equation for the potential on the bases of the two transistors Q1 and Q2:

$$V_{ref}+[I_C(Q1)+I_C(Q4)]\cdot R_2+U_{BE}(Q1)=U_{BE}(Q2)+I_C(Q2)\cdot R_4+I_L\cdot R_S \tag{1}$$

Because of the presence of the shunt the bases of the transistors Q1 and Q2 lie at the same potential as the collector of the first transistor, i.e. it is true that: $U_{CE}$(Q1)=$U_{BE}$(Q1) and furthermore $U_{CE}$ (Q2)=$U_{BE}$(Q3)−U (R4).

If the resistance value of R4 is selected such that U(R4) <<$U_{BE}$(Q3) applies, it follows that the collectors of the two transistors Q1 and Q2 lie at approximately the same potential, because the base-emitter voltages of the transistors Q1 to Q3 with suitable circuit dimensioning have approximately the same magnitudes. With Vb>>|$V_C$(Q1)−$V_C$(Q2)| it holds to a good approximation that:

$$\frac{I_C(Q1)}{I_C(Q2)}=\frac{R_3}{R_1}\Rightarrow I_C(Q2)=I_C(Q1)\cdot\frac{R_1}{R_3} \tag{2}$$

Insertion of equation (2) in equation (1) and solving for $I_L$ produces:

$$I_L=\frac{V_{ref}+I_C(Q1)\cdot R_2+I_C(Q4)\cdot R_2+U_{BE}(Q1)-U_{BE}(Q2)-I_C(Q1)\cdot\frac{R_1}{R_3}\cdot R_4}{R_s},$$

and after simplification:

$$I_L=\frac{V_{ref}+I_C(Q1)\cdot\left(R_2-\frac{R_1\cdot R_4}{R_3}\right)+I_C(Q4)\cdot R_2+U_{BE}(Q1)-U_{BE}(Q2)}{R_s}.$$

If one now selects $R_2$=($R_1$*$R_4$)/$R_3$, which in the circuit arrangement 1 of FIG. 1 is seen to be fulfilled, then $I_L$ is independent of $I_C$(Q1) and thus is also independent of the supply voltage Vb:

$$I_L=\frac{V_{ref}+I_C(Q4)\cdot R_2+U_{BE}(Q1)-U_{BE}(Q2)}{R_s}.$$

Since $I_C$(Q4) is a function of the load voltage $V_L$ (see above), it is true for the load current $I_L$, that the latter, as required in the introduction, is a function of $V_L$:

$$I_L=\frac{V_{ref}+\frac{V_L-U_{EB}(Q4)}{R_6}\cdot R_2+U_{BE}(Q1)-U_{BE}(Q2)}{R_s} \tag{3}$$

Here the comment must be made that equation (3) and all the equations that are derived from it are, strictly speaking, only valid for $V_L \geqq U_{EB}$(Q4), since $I_C$(Q4) does not become negative. Therefore a differentiation between cases is necessary:

For $V_L<U_{EB}$(Q4) it is true that:

$$I_L = \frac{V_{ref} + U_{BE}(Q1) - U_{BE}(Q2)}{R_s} \tag{3a}$$

For $V_L \geqq U_{EB}$(Q4) equation (3) applies. Since the equations described herein are primarily to be understood in a functional sense and only secondarily in a mathematical sense, in what follows only the case $I_L>0$ will be considered and described.

Figure 3:
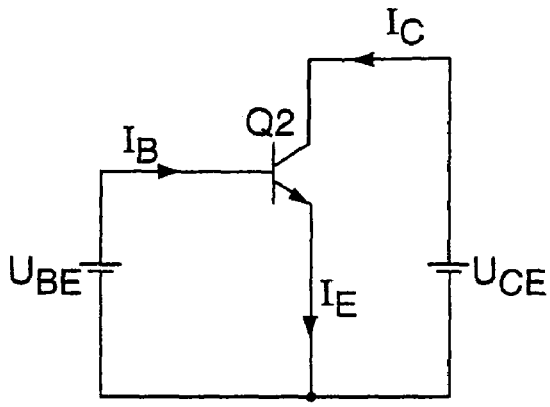
FIG. 3 shows a transistor of the circuit arrangement of FIG. 1 with related currents and voltages for the description of its temperature behaviour.

In order to understand that the current $I_L$ from equation (3), as required in the introduction, is a defined function of the temperature T, in FIG. 3 the second transistor Q2 is shown with the related collector, base and emitter currents $I_C$, $I_B$ and $I_E$ as well as the base-emitter voltage $U_{BE}$ and the collector-emitter voltage $U_{CE}$. Thus:

$$I_{C0}=B_0 \cdot I_B \tag{4}$$

$$I_{E0}=I_{C0}+I_B. \tag{5}$$

Here $I_{C0}$ denotes the collector current and $I_{EO}$ the emitter current in normal operation with a small collector-emitter voltage $U_{CE}$, and $B_0$ denotes the current amplification for this case. Insertion of (4) into (5) produces:

$$I_{E0}=B_0 \cdot I_B+I_B=(B_0+1) \cdot I_B, \tag{6}$$

while division of (4) by (6) produces:

$$\frac{I_{C0}}{I_{E0}} = \frac{B_0 \cdot I_B}{(B_0+1) \cdot I_B} \Rightarrow I_{C0} = \frac{B_0}{B_0+1} \cdot I_{E0}. \tag{7}$$

For the collector current $I_C$ it is generally true that:

$$I_C = I_{C0} \cdot \left(1 + \frac{U_{CE}}{U_A}\right) \tag{8}$$

where $I_C$ is the collector current as a function of the collector-emitter voltage $U_{CE}$ and $U_A$ is the Early voltage. The dependence of the collector current $I_C$ on the collector-emitter voltage $U_{CE}$ is hereby effected by the Early effect. $I_{C0}$ is the above indicated collector current, independent of the collector-emitter voltage $U_{CE}$ for $U_{CE} \ll U_A$, i.e. the collector current without taking account of the Early effect.

Insertion of (7) into (8) produces:

$$I_C = \frac{B_0}{B_0+1} \cdot I_{E0} \cdot \left(1 + \frac{U_{CE}}{U_A}\right) \tag{9}$$

In what follows the description of the relationship between current flow through and voltage drop across a PN junction, as is present between base and emitter of the transistor Q2 (emitter diode) is considered. Thus:

$$I_F = I_S \cdot e^{\frac{U_F}{n \cdot U_T}} \tag{10}$$

where $I_F$ denotes the current flow through a diode (PN junction), $I_S$ denotes the inverse saturation current, $U_F$ denotes the voltage drop across the diode in the flow direction, n denotes the emission coefficient and $U_T$ the temperature voltage.

Equation (10) takes the form of the very widely known Shockley equation, named after the inventor of the transistor, William Shockley. For the emitter diode in transistor Q2 it correspondingly ensues that:

$$I_{E0} = I_{ES} \cdot e^{\frac{U_{BE}}{n \cdot U_T}}, \tag{11}$$

where $I_{ES}$ denotes the inverse saturation current of the emitter diode. Insertion of (11) into (9) produces:

$$I_C = \frac{B_0}{B_0+1} \cdot I_{ES} \cdot e^{\frac{U_{BE}}{n \cdot U_T}} \cdot \left(1 + \frac{U_{CE}}{U_A}\right). \tag{12}$$

It is to be understood that the equations (4) to (12) describe the behaviour of a bipolar transistor in normal operation, i.e. with $U_{CE} \geqq U_{BE}>0$.

If equation (12) is inserted into equation (2), it follows that:

$$\frac{\frac{B_0(Q1)}{B_0(Q1)+1} \cdot I_{ES}(Q1) \cdot e^{\frac{U_{BE}(Q1)}{n(Q1) \cdot U_T(Q1)}} \cdot \left(1 + \frac{U_{CE}(Q1)}{U_A(Q1)}\right)}{\frac{B_0(Q2)}{B_0(Q2)+1} \cdot I_{ES}(Q2) \cdot e^{\frac{U_{BE}(Q2)}{n(Q2) \cdot U_T(Q2)}} \cdot \left(1 + \frac{U_{CE}(Q2)}{U_A(Q2)}\right)} = \frac{R_3}{R_1}. \tag{13}$$

If one uses thermally coupled transistors with paired properties (a dual transistor) as transistors Q1 and Q2, as in the circuit arrangement 1 of FIG. 1, then it holds that:

$$B_0(Q1) \approx B_0(Q2)$$

$$I_{ES}(Q1) \approx I_{ES}(Q2)$$

$$n(Q1) \approx n(Q2) = n$$

$$U_T(Q1) \approx U_T(Q2) = U_T.$$

In the circuit arrangement 1 of FIG. 1 Q1 and Q2 are operated with collector-emitter voltages that are significantly smaller than their Early voltage. For the BC846B used as a dual transistor in the circuit arrangement of FIG. 1 the inventor has determined the Early voltage; this lay at above 100 V. Therefore it is true for the circuit arrangement 1 that $U_{CE} \ll U_A$ and $|U_{CE}(Q1)-U_{CE}(Q2)| \lll U_A$, i.e. the influence of the Early effect can be neglected with confidence. Equation (13) therefore simplifies to:

$$\frac{e^{\frac{U_{BE}(Q1)}{n \cdot U_T}}}{e^{\frac{U_{BE}(Q2)}{n \cdot U_T}}} = \frac{R_3}{R_1} \Rightarrow \ln\left(\frac{e^{\frac{U_{BE}(Q1)}{n \cdot U_T}}}{e^{\frac{U_{BE}(Q2)}{n \cdot U_T}}}\right) = \ln\left(\frac{R_3}{R_1}\right)$$

and thus to:

$$\frac{U_{BE}(Q1)}{n \cdot U_T} - \frac{U_{BE}(Q2)}{n \cdot U_T} = \ln\frac{R_3}{R_1}, \text{ or} \tag{14}$$

$$U_{BE}(Q1) - U_{BE}(Q2) = n \cdot U_T \cdot \ln\frac{R_3}{R_1}.$$

If equation (14) is inserted into equation (3), the following therefore ensues:

$$I_L = \frac{V_{ref} + \frac{V_L - U_{EB}(Q4)}{R_6} \cdot R_2 + n \cdot U_T \cdot \ln\frac{R_3}{R_1}}{R_s}. \quad (15)$$

$U_T$ is the temperature voltage and corresponds to the potential difference that a thermally excited electron on average can overcome on the basis of its kinetic energy at a temperature T. Thus:

$$U_T = \frac{k \cdot T}{e} = \frac{1{,}3807 \cdot 10^{-23} \cdot \frac{\mathrm{J}}{\mathrm{K}}}{1{,}6022 \cdot 10^{-19} \cdot As} \cdot T = 86{,}17\ \frac{\mu\mathrm{V}}{\mathrm{K}} \cdot T, \quad (16)$$

where k denotes the Bolzmann constant, T the absolute temperature, and e the elementary charge. Insertion of (16) into (15) produces:

$$I_L = \frac{V_{ref} + \frac{V_L - U_{EB}(Q4)}{R_6} \cdot R_2 + n \cdot 86{,}17\ \frac{\mu\mathrm{V}}{\mathrm{K}} \cdot T \cdot \ln\frac{R_3}{R_1}}{R_s}. \quad (17)$$

One obtains the temperature coefficient of $I_L$, by differentiating equation (17) with respect to the absolute temperature T (the temperature coefficient of $U_{EB}$(Q4) is here neglected):

$$\frac{dI}{dT} = \frac{n}{R_s} \cdot 86{,}17\ \frac{\mu\mathrm{V}}{\mathrm{K}} \cdot \ln\frac{R_3}{R_1} \quad (18)$$

Figure 4:
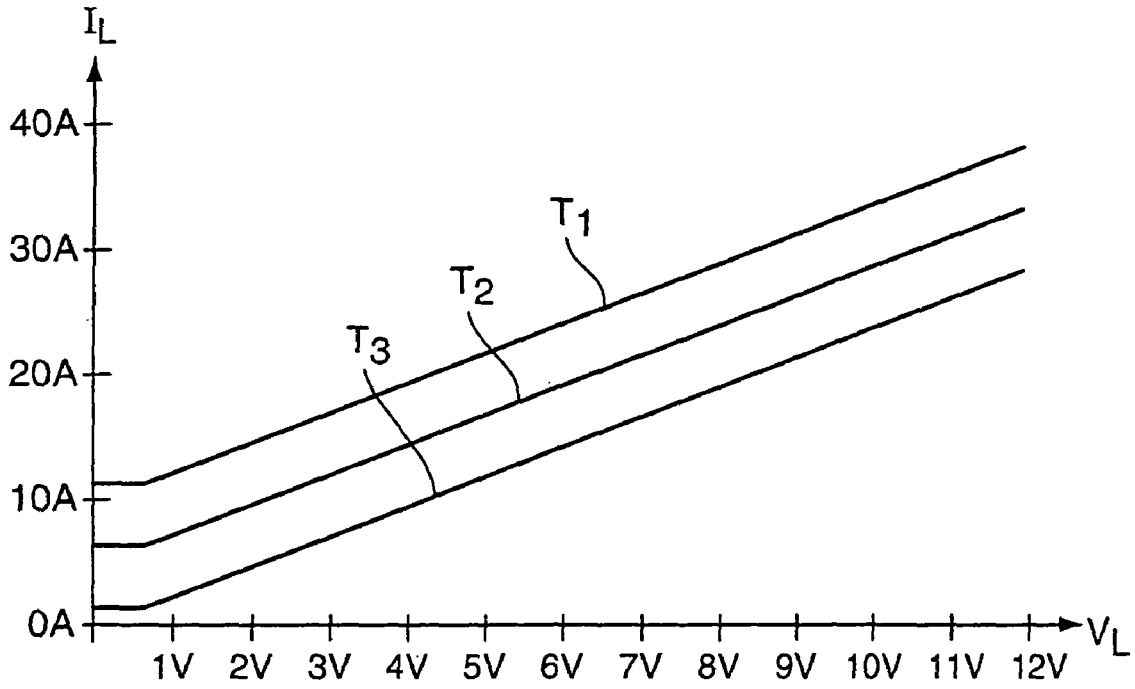
FIG. 4 shows three current-voltage characteristics of the application-specific dimensioned current control circuit of FIG. 1 at various temperatures.

Bipolar small signal transistors, which are used with small collector currents in normal operation, as is the case in the circuit arrangement 1 of FIG. 1, usually have an emission coefficient n=1. Their base-emitter PN junction is highly doped and has a characteristic gradient similar to that of an ideal PN junction, but only a small blocking capability. The temperature dependence I=f(T) of the arrangement according to FIG. 1 is thus only a function of the circuit dimensioning and the temperature voltage. Since the temperature voltage can be traced back to physical constants, it can likewise be considered as a physical constant; I=f(T) is thus determined. The equations (17) and (18) are confirmed to a good approximation by SPICE simulations and laboratory measurements, the results of which are represented for the current-voltage characteristic ($I_L(V_L)$) in FIG. 4 for three temperature values $T_1$=−25° C., $T_2$=50° C. and $T_3$=125° C.

The circuit arrangement 1 of FIG. 1 comprises comparatively few components and can be implemented in the form of discrete components cost-effectively. Transistor circuits comprising discrete components have a typical working temperature range from −40° C. to +150° C. and are particularly well suited for use in a motor vehicle, where comparatively high and low ambient temperatures occur. Thus the arrangement can particularly advantageously find application as a short-circuit and threshold current regulator for a fan motor in a car. It is to be understood that instead of the voltage $V_S$ on the shunt resistance $R_S$ another variable proportional to the load current $I_L$ can also be selected as a control variable, e.g. the output signal of a current sensor, although this would require additional active components.

Also the circuit arrangement 1 can not only be used for the regulation of a fan motor, but with corresponding conversion can also be designed for loads with another form of temperature behaviour. This is e.g. the case if a load is present for which the load current $I_L$ is to increase with increasing temperature. In this case the circuit arrangement 1 can be provided with a positive temperature coefficient, in particular by selecting the ratio of the third resistance R3 to the first resistance R1 to be greater than one. The circuit arrangement can hereby also serve to provide compensation for any temperature dependence of the reference voltage $V_{ref}$ that may be present, if the latter is created in terms of a diode circuit—as is usual in motor vehicles on cost grounds. Also by the identical selection of the collector quiescent currents a circuit arrangement can be produced, the behaviour of which does not depend on temperature, which in particular can be advantageous in the case of loads that likewise do not show any temperature dependence.

The circuit arrangement shown in FIG. 1 has an essentially proportional or inversely proportional functional dependence of the load current $I_L$ on the load voltage $V_L$ and/or the temperature T. It is to be understood that also by means of suitable modification of the circuit arrangement 1 almost any other functional dependencies of the form $I_L$=f ($V_L$, T) can be adjusted, whereby the circuit arrangement 1 can be adapted to a large number of different types of loads.

What is claimed is:

1. A circuit arrangement for the regulation of a fan motor current ($I_L$) through a load ($R_L$), the arrangement comprising:

a resistance ($R_S$), through which a fan motor load current ($I_L$) flows and across which a voltage ($V_S$) drops, which serves as a control variable (X) for the regulation of the fan motor load current ($I_L$);

a tapping point (P) for a reference voltage ($V_{ref}$), which serves as a command variable (W) for the regulation of the fan motor load current ($I_L$);

a differential amplifier (OV) for the amplification of the control deviation (W - X) between command variable (W) and control variable (X), said differential amplifier having a first and a second base-coupled transistor ($Q_1$, $Q_2$); and a transistor (Q4), a collector resistance (R2) and an emitter resistance (R6) for the regulation of the fan motor load current ($I_L$) as a function of a load voltage ($V_L$), and including a device for the adjustment of a constant ratio of the collector quiescent currents through the base-coupled transistors ($Q_1$, $Q_2$), which is formed by two resistances ($R_1$, $R_3$), said device being adapted to reduce a maximum load current through the fan motor with increasing temperature wherein the series connection of the base-emitter section of the fourth transistor (Q4) and the emitter resistance (R6) is arranged parallel to the load ($R_L$), and wherein the tapping point (P) for the reference voltage is arranged between the collector resistance (R2) and the transistor (Q4).

2. The circuit arrangement according to claim 1, wherein the base-coupled transistors (Q1, Q2) have identical collector-emitter voltages.

3. The circuit arrangement according to claim 1 wherein the base-coupled transistors (Q1, Q2) are formed by a dual transistor.

4. The circuit arrangement according to claim 1 further comprising at least one power transistor (M1), as an actuating element for the adjustment of the load current ($I_L$).

5. The circuit arrangement according to claim 4 further comprising a third transistor (Q3) for the regulation of the control voltage of the farther transistor (M1) in a limiting manner.

6. The circuit arrangement according to claim 5, wherein the differential amplifier (Q1, Q2) and the third transistor (Q3) are placed in the circuit such that the third transistor (Q3) adjusts the control voltage of the further transistor (M1) as a function of the control deviation (W - X).

7. The circuit arrangement according to claim 1 comprising discrete components.

* * * * *